US005395467A

United States Patent [19]

Rogers, Jr.

[11] Patent Number: 5,395,467

[45] Date of Patent: * Mar. 7, 1995

[54] METHOD FOR MAKING A WATER PERMEABLE LAMINATED TEXTILE PRODUCT SUCH AS ARTIFICIAL TURF

[76] Inventor: James H. Rogers, Jr., 1921 Farington Rd., Dalton, Ga. 30720

[ * ] Notice: The portion of the term of this patent subsequent to Apr. 7, 2009 has been disclaimed.

[21] Appl. No.: 521,338

[22] Filed: May 9, 1990

Related U.S. Application Data

[63] Continuation-in-part of Ser. No. 353,795, May 18, 1989, Pat. No. 5,102,482.

[51] Int. Cl.[6] ..... B32B 31/12; B32B 31/00

[52] U.S. Cl. ..... 156/61; 156/72; 156/87; 156/253; 156/513; 156/529; 428/17

[58] Field of Search ..... 156/61, 72, 87, 252–253, 156/497, 513, 529; 181/292; 428/17

[56] References Cited

U.S. PATENT DOCUMENTS

| | | | |
|---|---|---|---|
| 3,038,198 | 6/1962 | Schaar | 156/497 |
| 3,322,584 | 5/1967 | Welin-Berger | 156/497 X |
| 3,380,229 | 4/1968 | Nelson | 156/497 |
| 3,922,454 | 11/1975 | Roecker . | |
| 4,007,307 | 2/1977 | Freidrich | 428/17 |
| 4,249,974 | 2/1981 | Wilson | 156/252 X |
| 4,268,551 | 5/1981 | Moore, Jr. . | |
| 4,291,079 | 9/1981 | Hom | 181/292 X |
| 4,389,434 | 6/1983 | Polman | 428/17 |
| 4,433,021 | 2/1984 | Riel | 181/292 X |
| 4,512,831 | 4/1985 | Tillotson . | |
| 4,539,244 | 9/1985 | Beggs et al. | 181/292 X |
| 4,738,407 | 4/1988 | Arrant . | |
| 4,990,201 | 2/1991 | Trnka | 156/253 X |
| 5,019,194 | 5/1991 | Friedrich | 156/61 |
| 5,102,482 | 4/1992 | Rogers, Jr. | 156/72 |

FOREIGN PATENT DOCUMENTS

| | | | |
|---|---|---|---|
| 52-077265 | 6/1977 | Japan | 156/61 |

*Primary Examiner*—Michael W. Ball
*Assistant Examiner*—Adrienne C. Johnstone
*Attorney, Agent, or Firm*—Needle & Rosenberg

[57] ABSTRACT

A method of producing a textile product has the steps of applying an adhesive coating to a first surface of a backing material having a first and second surface; passing a fluid towards the backing material to form a plurality of spaces through the adhesive and the backing material; and adhering the backing material to a textile fabric.

20 Claims, 3 Drawing Sheets

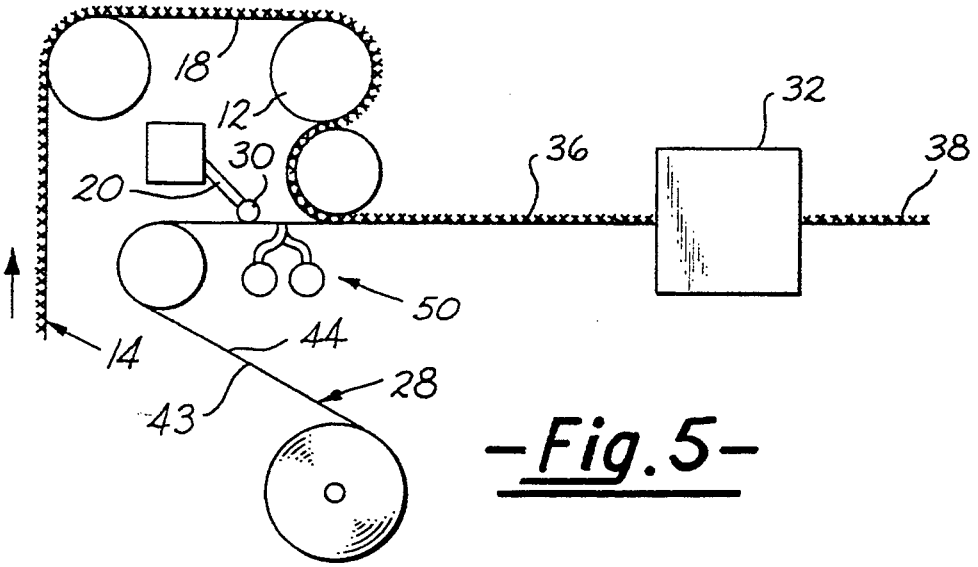
-Fig.5-
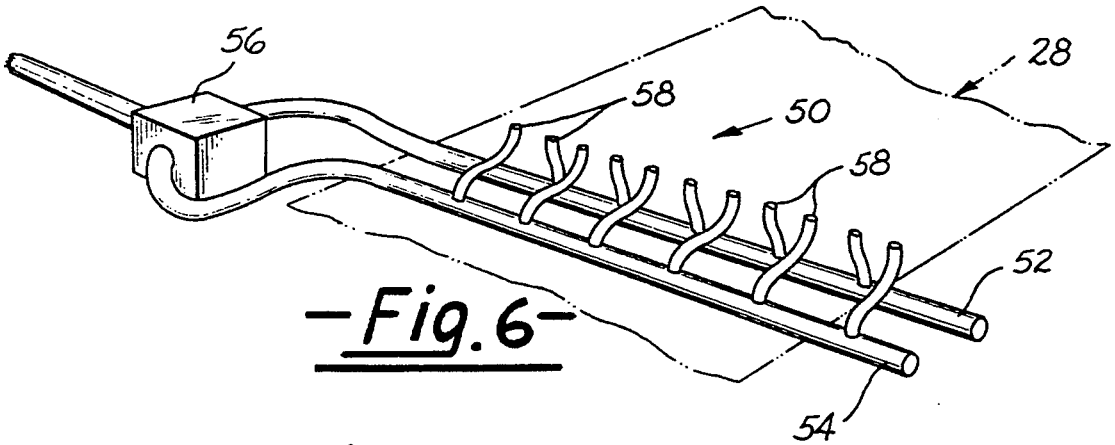
-Fig.6-
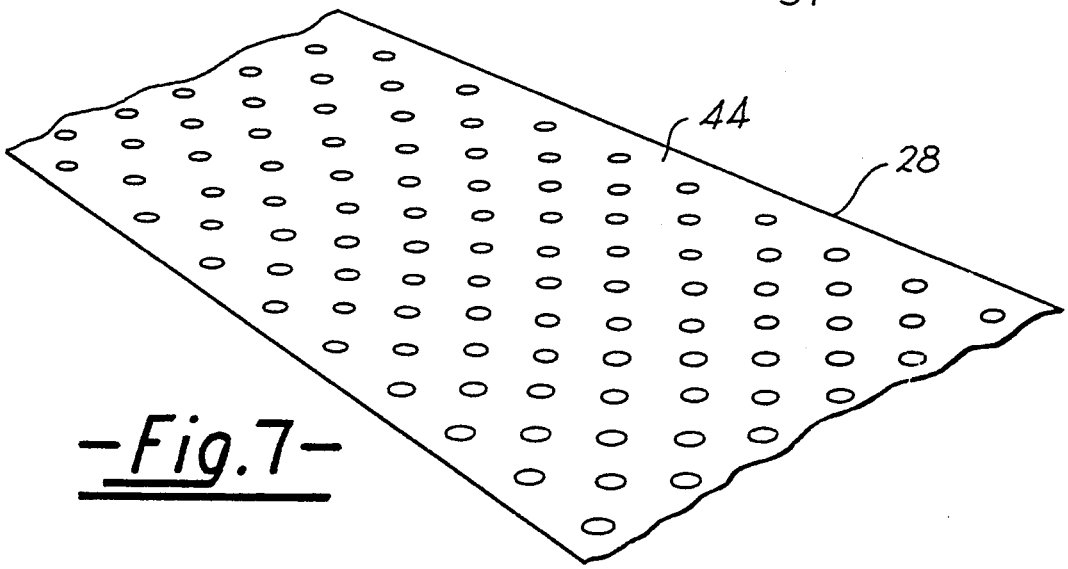
-Fig.7-

METHOD FOR MAKING A WATER PERMEABLE LAMINATED TEXTILE PRODUCT SUCH AS ARTIFICIAL TURF

The present application is a continuation-in-part application of application Ser. No. 07/353,795, entitled "METHOD AND APPARATUS FOR MAKING A WATER PERMEABLE LAMINATED, TEXTILE FABRIC PRODUCT", filed May 18, 1989, now U.S. Pat. No. 5,102,482.

BACKGROUND OF THE INVENTION

The present invention relates to the textile industry, and more particularly to a water permeable, laminated textile product, such as artificial turf.

The use of artificial turf as an outdoor playing surface is known. One disadvantage of artificial turf, and of all textile fabrics in general, is that they have an inadequate amount of dimensional stability. Knitted products in particular have poor dimensional stability because of the large amount of space between individual fibers. The lack of stability causes the textile products to either stretch, pucker, wrinkle or generally lose shape when under stress. For example, large expanses of artificial turf are subject to extreme amounts of deformity due to exposure to harsh climatic conditions, as well as to the physical punishment experienced during athletic events.

The most preferred method of accomplishing dimensional stability in a textile product is laminating a scrim onto the rear surface of the textile fabric. This typically requires placing a coating of adhesive across the entire fabric rear surface. A problem exists, however in that the adhesive tends to harden in the spaces between the fibers of the textile fabric, thereby creating a water barrier. As a result, the textile product becomes impermeable to water. This problem is of particular importance in the case of artificial turf because rain water and other liquids become trapped on and within the turf surface and interfere with events. Furthermore, the presence of the adhesive tends to create a vapor barrier between the ground surface and turf, which in turn is detrimental in allowing fumes from cements or glues to evaporate during installation of the turf. To overcome this problem, holes have been punched through the textile product. This, however, results in diminished dimensional stability.

Therefore, there exists a need for a textile product which includes a scrim backing and Which is water and vapor permeable.

There exists a further need for such a product which maintains adequate dimensional stability.

SUMMARY OF THE PRESENT INVENTION

The present invention relates to a method and apparatus for producing a water permeable textile product, such as artificial turf. According to one embodiment of the method, an adhesive coating is applied to the rear surface of a textile fabric. A pressurized fluid, such is air, is passed through the front surface of the textile fabric to form a plurality of openings through the adhesive and the fabric by forcibly dislodging a portion of the adhesive coating from fewer than all of the spaces in the backing material. This will act to remove adhesive from the space between fibers of the fabric while leaving the adhesive on the fibers themselves. A water permeable scrim backing is then adhered to the textile fabric to form the laminated textile product.

Alternatively, the adhesive coating may be applied to a first surface of the backing material, and the fluid may be passed towards the adhesive to form a plurality of spaces through the adhesive and the backing material. The backing material may then be adhered to a textile fabric.

The present method produces a textile product which has a plurality of openings through the textile fabric leading to the water permeable scrim, thereby making the entire product water permeable. This is particularly useful when the product is an artificial turf, such as that used on a playing field, because the turf will have both dimensional stability and water permeability.

Therefore, it is an object of the present invention to provide a textile product which includes a scrim backing for stability and which is water permeable.

BRIEF DESCRIPTION OF THE FIGURES OF THE DRAWINGS

FIG. 5 is a schematic of an alternate embodiment of an apparatus for performing the method of the present invention.

FIG. 6 is an illustration of a dual-tube manifold which may be utilized in the method of the present invention.

FIG. 7 illustrates an example of a pattern of holes which may be provided in a textile product according to the method of the present invention.

DETAILED DESCRIPTION OF THE PREFERRED EMBODIMENT

The present invention relates to a method and apparatus for producing a water and vapor permeable textile product having a secondary backing, such as a scrim. The process for manufacturing the product includes three primary steps. In a first embodiment, an adhesive coating is applied to the rear surface of a web of textile fabric, preferably knitted, having a front surface and a rear surface and which is moving along a certain path of travel. A fluid, such as compressed air, is then blown or otherwise passed through the front surface of the fabric to remove adhesive from the spaces between the fabric fibers while leaving adhesive on the fiber a themselves. Then, downstream from the fluid, a water permeable scrim backing is mated to the rear surface of the textile fabric. The laminate of the fabric with the scrim thereon is then cured to form the finished product. The backing may be woven, knit, nylon mesh, or any other material capable of providing dimensional stability to the overlying fabric. Also, the backing may be a water permeable shock-absorbing pad.

Many types of adhesive, such as polyurethane, natural latex or carboxylated latex, may be used in the present invention. However, polyurethane is preferred since it will withstand ultraviolet rays, moisture, heat, cold and other inclement weather conditions. Preferably, the adhesive weight should be in the range from about 24 ounces per square yard to about 40 ounces per square yard, depending on the fabric being coated. However, the weight may vary depending on other factors such as the type of adhesive and coating thickness desired. Furthermore, the adhesive should be sufficiently viscous to ride on top of the fibers without "wicking into" or otherwise clogging the spaces between the fibers. This viscosity may be achieved by adding thickener and/or injecting air bubbles into the adhesive. The injection of air bubbles provides the additional advantage of adding bulk and weight control to the adhesive.

Figure 2:
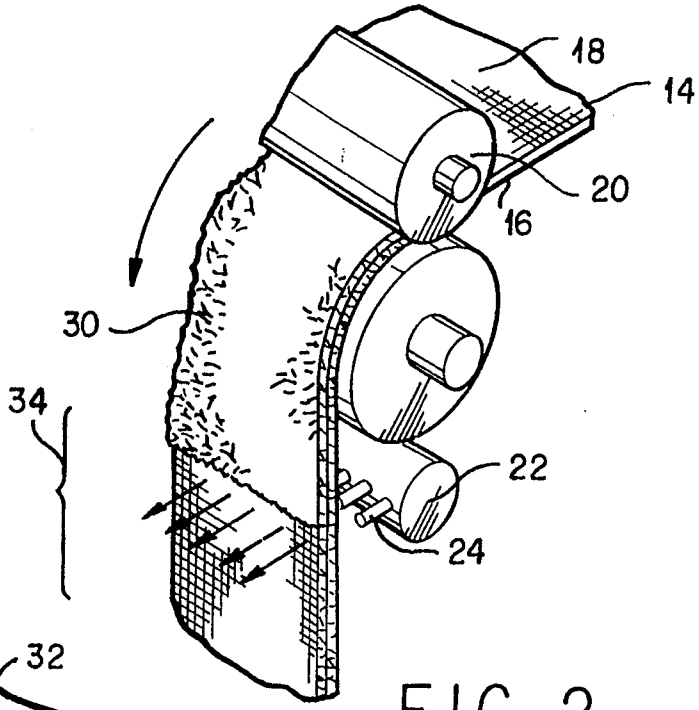
FIG. 2 is a perspective view of an apparatus and textile fabric product according to the present invention.
Figure 1:
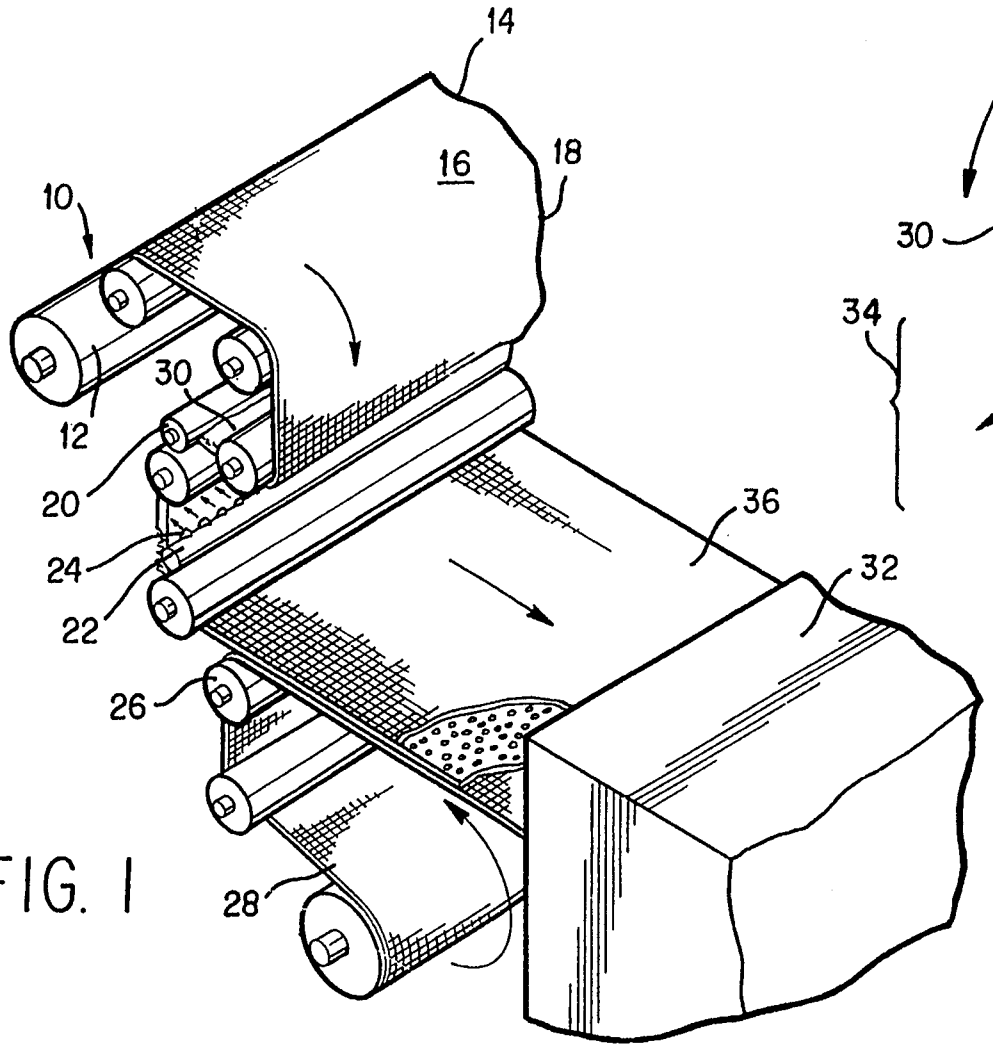
FIG. 1 illustrates an apparatus according to the present invention

FIGS. 1 and 2 illustrate one embodiment of an apparatus 10 according to the present invention. The apparatus 10 preferably includes means, such as a standard roller type device 12, for moving along a certain path of travel a web of textile fabric 14 having a front 16 and rear 18 surface. Also provided are means along the path for applying an adhesive coating to the rear surface 18 of the fabric 14. For example, the adhesive may be metered from a standard rolling puddle type adhesive application device 20. Means for passing a pressurized fluid into a portion of the fabric front surface 16 are provided along the path of the travel downstream from the adhesive applying means. The fluid passing means may be an air manifold 22 having one or more air jets 24 laterally extending across the path of travel of the fabric 14 and directed at the front surface 16. Means, such as a standard roller-type device 26, for adhering a water permeable backing to the rear surface 18 of the textile fabric 14 are provided along the path downstream of the fluid passing means.

In operation, the rear side 18 of a continuous roll or web of textile fabric 14 is coated with an adhesive 30 as described above. The fabric 14 is then passed in front of the air manifold 22 containing a plurality of evenly spaced air jets 24 expelling compressed air through the front surface 16 of the fabric 14. The adhesive 30, which had been coated to the rear surface 18 of the fabric 14, is consequently blown out of the spaces between the fibers of the fabric 14 in those areas in line with the air jets 24. After the fabric 14 passes in front of the manifold 22, a water permeable secondary backing 28 is supplied from a second roll and mated or otherwise adhered to the rear surface 18 by means of the adhesive 30 remaining on the fibers themselves. Once the fabric 14 and backing 28 are adhered, the resulting laminate 36 preferably thereafter enters a curing oven 32 to create the final textile product 38, illustrated in FIG. 4. The curing should be performed after the air is applied in order to remove the adhesive 30 from the spaces before the adhesive 30 solidifies.

The manifold 22 preferably stretches the full width of the fabric 14 and is adjustable to accommodate different widths of fabric 14. Air jets 24 are preferably evenly spaced across the width of the manifold 22 and have narrow openings, such as approximately ¼ inch in diameter. The number of air jets 24 along the manifold 22 should be selected to provide a proper amount of air flow through the fabric 14 to (1) remove enough adhesive 30 between the fabric fibers to allow adequate permeability in the final textile product 38 but still retain enough adhesive on the fabric fibers themselves to insure a dependable bond between the textile fabric 14 and the secondary backing 28. The air pressure used by the manifold 22 should be low enough to prevent disturbing the textile fibers, while great enough to remove the adhesive 30. Thus, the heavier the adhesive 30 the greater the pressure need be to remove it from the spaces. To achieve this, a pressure regulator between the source of pressurized air (not shown) and the manifold 22 may be used. Also, a curtain 34 or other collecting means may be erected behind the rear surface 18 of the textile fabric 14 to collect any adhesive 30 that splatters due to the air being applied to the fabric 14.

FIG. 5 illustrates an alternate embodiment of the present invention. The apparatus preferably includes a roller-type device 12 for moving the textile fabric 14, with front 16 and back 18, along a certain path. It may also include a similar roller-type device for moving a water permeable backing 28, with top 43 and bottom 44, along a specified path. Also provided are means for applying the adhesive along the top 43 of the water permeable backing 28. For example, the adhesive, such as a liquid polyurethane, may be applied in solid sheet to the top 43 of the backing 28 by standard rolling-type, puddle application device 20. After application of the adhesive, the apparatus provides means for passing a pressurized fluid, such as air, through the bottom 44 of the backing 28. The fluid passing device may be a dual or multi-tube manifold 50, FIG. 6. The manifold tubes 52 and 54 laterally extend across the path of the moving adhesive-covered backing 28 and alternatively direct pressurized fluid to the bottom 44 of backing 28. Means for creating a pattern of air induced holes in the adhesive covering, may be provided through an air pulse devise, like an electronic diverter valve 56. The air diverter device accepts the compressed air from its source and alternatively pulses the pressurized air to the separate manifold tubes 52 and 54. Means for mating the back 18 of the textile fabric 14 to the top 43 of the water permeable backing 28 may be provided farther down the path by standard roller-type means.

Figure 3:
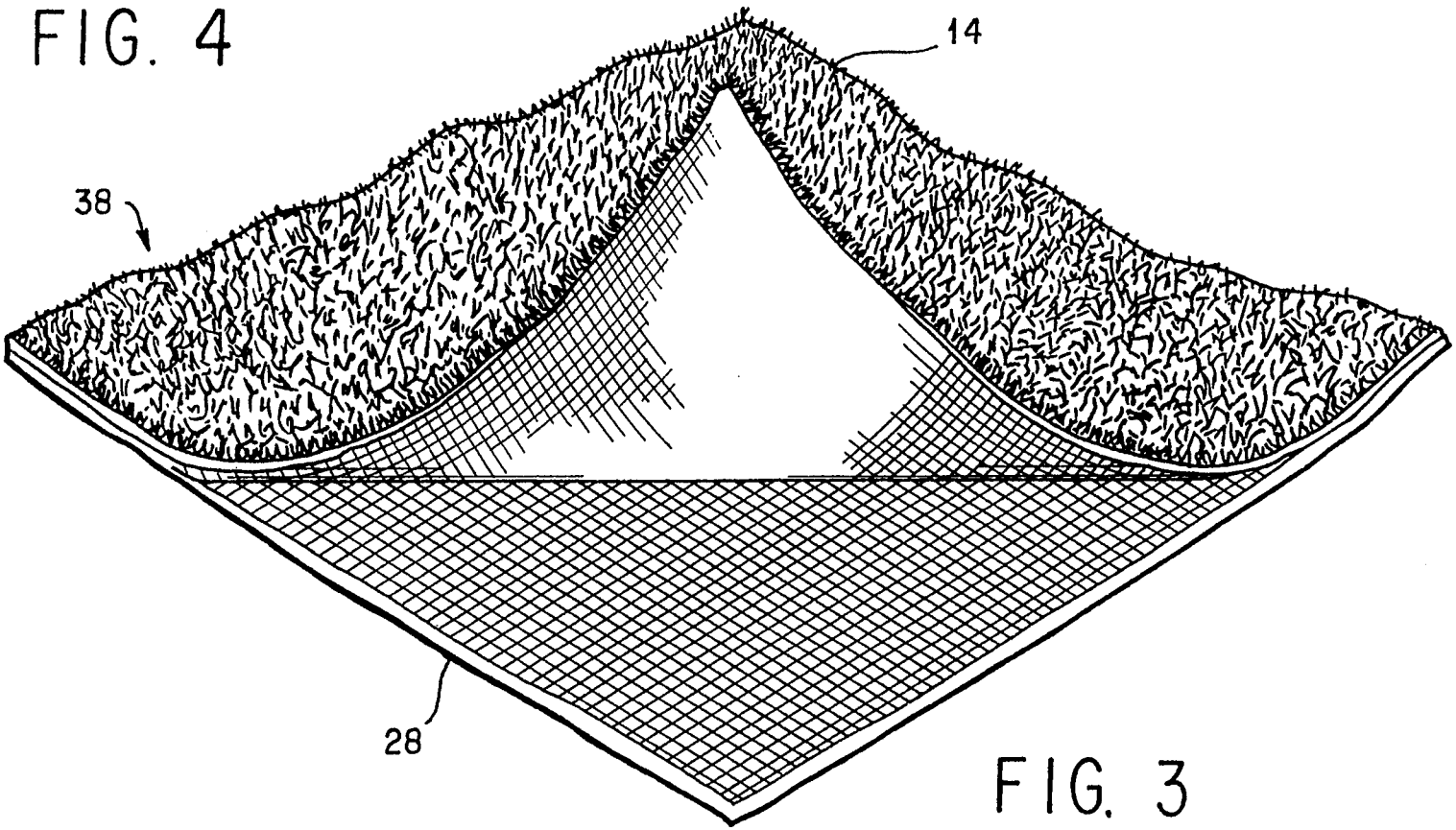
FIG. 3 is a perspective view of a textile product of the present invention having its textile fabric layer and scrim layer separated to show the adhesive.

In operation, the top side 43 of a continuous roll of water-permeable backing 28 is coated with an adhesive 30. The coated backing 28 is then passed in front of an air manifold 22. The manifold's tubes 52 and 54 contain a plurality of evenly spaced holes that are staggered with respect to its adjacent tube. The staggered holes are extended preferably with tubes and placed in a single, lateral line that extends across the backing's width. The air diverter valve 56 evenly distributes the compressed air to the different tubes by alternating the air flow to the tubes 52 and 54. Thus, as the backing 28 pases in front of the manifold jets 58 every other jet blows through the bottom 44 of the backing 28, at any one moment. It thus blows out a pattern of air holes in the adhesive coat. The multi-tube manifold 50 preferably extends the full width of the backing and may be adjustable to accomodate different widths of backing. The multi-tubes 52 and 54 preferably have staggered, evenly spaced holes which are extended outwards into a single line of holes. The tubes 52 and 54 have connections to a diverter valve 56 which alternates pulses of pressurized air to the tubes. With the alternating pulses of air and the subsequent air pulses, the pressurized air removes adhesive from the backing and creates a pattern, such as shown in FIG. 3. The moving rate of the fabric 14 along the path and the rate of air pulses to the tubes 52 and 54 maybe varied to create fewer or more air holes in the adhesive. The number of air holes in the adhesive can be adjusted to meet the structural stability and water permeability requirements The top 43 of the backing 28 is then mated with or otherwise adhered to the back 18 of the textile fabric 14 by means of the remaining adhesive on the backing. Once the backing and the fabric are joined, the resulting laminate 36 enters a curing oven 32 which creates the final product 38.

Figure 4:
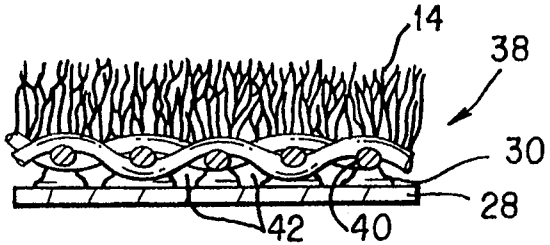
FIG. 4 is a cross-sectional view of a textile product according to the present invention.

As a result of the above methods, the textile product 38, shown in FIGS. 3 and 4, will have adhesive 30 bonding the fibers 40 of the textile fabric 14 to the backing 28 or scrim, and open spaces 42 through its fabric 14 leading to the water permeable secondary backing 28. The product 38 will be water permeable and suitable for use as ah artificial turf or any other application in which both dimensional stability and drainage of water is desired.

It is also possible to the present invention to produce a water permeable textile product having improved dimensional stability without a scrim. For example, a coating of foamed polyurethane adhesive may be applied to the fibers 40 of a textile fabric 14, such as by scrape coating, and left to dry. The polyurethane, once dried, reinforces the textile fabric 14. According to one embodiment of the present invention, air or other fluid may be passed through the fabric 14 to remove wet adhesive coating from the fabric, as described above, to produce a water permeable textile product.

What is claimed is:

1. A method of producing a textile product comprising the steps of a. applying a liquid adhesive coating to a first surface of a backing material having a first and second surface;

b. passing a fluid in a selectable pattern towards said backing material to form a plurality of spaces in the selectable pattern through said adhesive and said backing material by forcibly dislodging a portion of the adhesive coating from fewer than all of the spaces in the backing material; and c. adhering said backing material to a textile fabric.

2. The method of claim 1, wherein said backing material is water permeable.

3. The method of claim i, wherein said backing material is vapor permeable.

4. The method of claim i, wherein said fluid is passed towards said second surface of said backing material.

5. The method of claim i, wherein said passing step comprises the step of moving said backing material over a source of said fluid.

6. The method of claim 1, wherein said backing material is a shock-absorbing pad.

7. The method of claim 1, wherein said fluid is pressurized air.

8. The method of claim 7, wherein said fluid is passed towards said adhesive coating from a plurality of air jets.

9. The method of claim 8, wherein said air jets provide intermittent pulses of air towards said adhesive coating.

10. The method of claim 1, and further comprising the step of collecting the adhesive coating forced off said backing material by said fluid.

11. The method of claim 1, wherein said adhesive coating is thickened prior to being applied to said backing material.

12. A method of producing a textile product comprising the steps of:

(a) moving a web of backing material having front and rear surfaces along a path of travel;

(b) applying a liquid adhesive coating to said front surface of said backing material;

(c) passing fluid towards said rear surface of said backing material to form a plurality of spaces through said adhesive coating and said backing material by forcibly dislodging a portion of the adhesive coating from fever than all of the spaces in the backing material to create a selectable pattern of spaces in the adhesive; and (d) adhering textile fabric to said backing material to form the textile product.

13. The method of claim 12, wherein said backing material is water permeable.

14. The method of claim 12, wherein said backing material is vapor permeable.

15. The method of claim 12, wherein said backing material is a shock-absorbing pad.

16. The method of claim 12, wherein said fluid is pressurized air.

17. The method of claim 12, wherein said fluid is passed towards said adhesive coating from a plurality of air jets.

18. The method of claim 17, wherein said air jets provide intermittent pulses of air towards said adhesive coating.

19. The method of claim 12, and further comprising the step of collecting the adhesive coating forced off said backing material by said fluid.

20. The method of claim 12, wherein said adhesive coating is thickened prior to being applied to said backing material.

* * * * *